United States Patent [19]

La Barge et al.

[11] Patent Number: 4,991,732

[45] Date of Patent: Feb. 12, 1991

[54] EXCESS PRESSURE VENT FOR RESEALABLE BEVERAGE CAP

[75] Inventors: Robert L. La Barge, Ben Avon Borough; Thomas P. Grzybek, Lower Burrell, both of Pa.

[73] Assignee: Aluminum Company of America, Pittsburgh, Pa.

[21] Appl. No.: 338,096

[22] Filed: Apr. 14, 1989

[51] Int. Cl.[5] ..... B65D 51/16

[52] U.S. Cl. ..... 215/260; 220/209; 220/366

[58] Field of Search ..... 215/260, 270, 307; 220/203, 204, 209, 366, 367, 271

[56] References Cited

U.S. PATENT DOCUMENTS

| | | | |
|---|---|---|---|
| 2,953,272 | 9/1960 | Mumford et al. | 215/260 |
| 3,047,177 | 7/1962 | Poitras et al. | 215/260 |
| 3,549,038 | 12/1970 | Lohrer | 215/260 |
| 3,756,448 | 8/1973 | Moller et al. | 220/271 |
| 3,807,597 | 4/1974 | Wells et al. | 220/48 |
| 3,902,626 | 9/1975 | Jordan et al. | 220/268 |
| 3,912,114 | 10/1975 | Morran et al. | 220/268 |
| 3,929,251 | 12/1975 | Urmston | 220/268 |
| 3,938,455 | 2/1976 | Urmston | 11.3/121 |
| 3,946,683 | 3/1976 | Jordan | 113/15 |
| 3,977,341 | 8/1976 | Jordan et al. | 113/15 |
| 3,997,076 | 12/1976 | Jordan | 220/268 |
| 4,024,981 | 5/1977 | Brown | 220/269 |
| 4,039,101 | 8/1977 | Wells | 220/269 |
| 4,148,410 | 4/1979 | Brown | 220/269 |
| 4,315,578 | 2/1982 | Ludwig, Jr. | 220/366 |
| 4,564,116 | 1/1986 | Prohaska | 215/307 X |
| 4,580,692 | 4/1986 | La Barge et al. | 220/240 |
| 4,648,528 | 3/1987 | La Barge et al. | 220/240 |
| 4,664,288 | 5/1987 | Pereira et al. | 220/209 |
| 4,673,099 | 6/1987 | Wells | 220/269 |
| 4,678,096 | 7/1987 | La Barge et al. | 220/273 |
| 4,685,849 | 8/1987 | La Barge et al. | 413/22 |
| 4,760,936 | 8/1988 | Mueller | 220/366 |
| 4,783,985 | 11/1988 | La Barge et al. | 72/379 |
| 4,793,510 | 12/1988 | Arfert et al. | 220/306 |

*Primary Examiner*—Stephen Marcus
*Assistant Examiner*—Nova Stucker
*Attorney, Agent, or Firm*—David W. Brownlee; William J. O'Rourke, Jr.

[57] ABSTRACT

This invention relates to an improved can end construction for carbonated beverage cans having a score line defined opening panel incorporated in a selectively contoured pouring spout configuration for accommodation of an automatic pressure releasing resealing cap assembly engageable therewith.

14 Claims, 3 Drawing Sheets

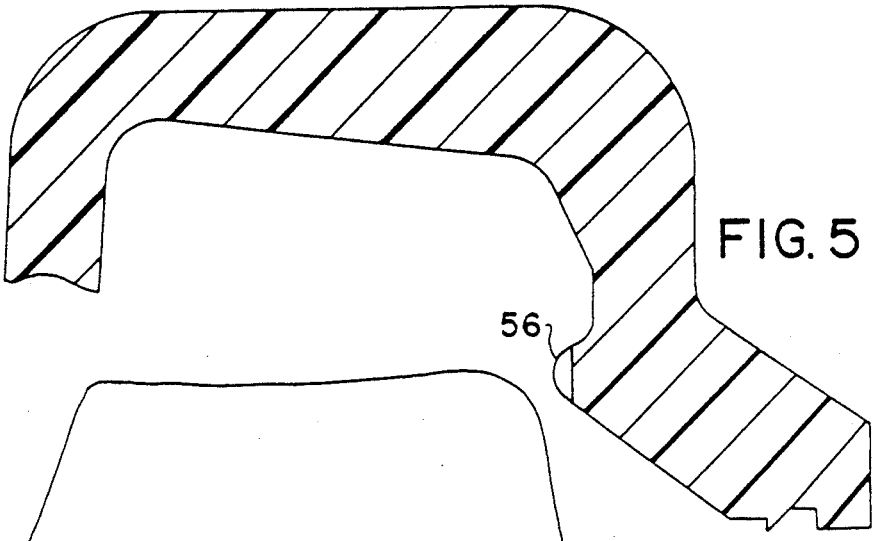
FIG. 5
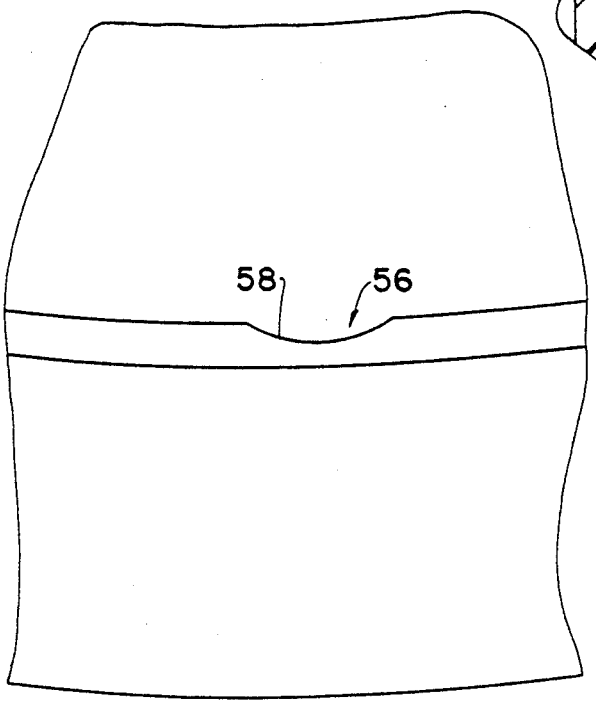
FIG. 6A
FIG. 6B
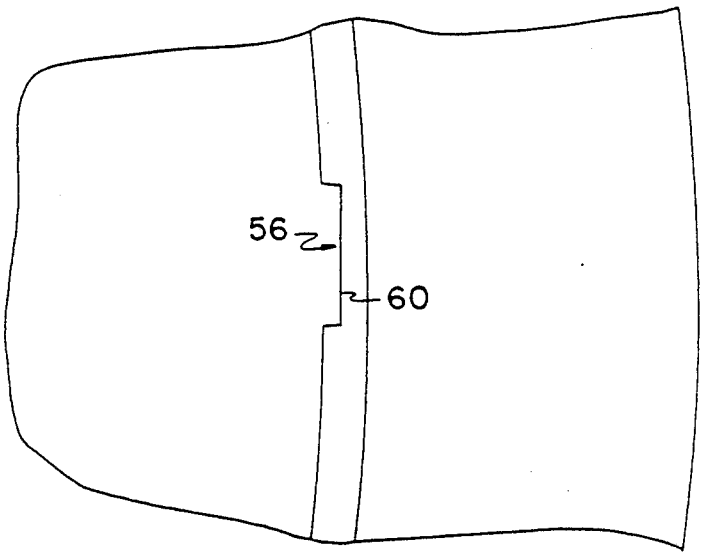

EXCESS PRESSURE VENT FOR RESEALABLE BEVERAGE CAP

BACKGROUND OF THE INVENTION

Recent years have witnessed ever increasing quantities of carbonated beverages, such as beer and carbonated soft drinks, being packaged in amounts up to 12 ounces in metal cans and particularly in metal cans with end closures that include a score line defined opening panel therein to provide implement free access to the contents. Such opening panel containing can ends are generally called "easy open ends" and include variant basic constructions of a first type wherein the score line completely circumscribes the panel to render the panel completely separable from the can end and of a second type wherein the score line only partially circumscribes the panel to render the latter only partially severable from the can end and to thus remain in attached relation within the can end after the pouring opening has been formed. As mentioned above, such opening panels are conventionally perimetrically delineated by score lines of decreased metal thickness.

In order to extend the use of such easy open can end constructions to larger volume containers, the art has suggested the utilization of a cap assembly to close and reseal the opening defined by such score line defined panel. Among the objects of such cap utilization are a re-closure of the container to prevent loss of liquid content and a resealing of the container to limit further losses of the dissociable gases, i.e., the "carbonation", of the remaining liquid contents. U.S. Pat. No. 4,580,692discloses one construction for such a resealable closure cap assembly in association with a selectively contoured can end construction to cooperatively accommodate such resealable closure and to retain the advantages characteristic of the "easy open end" construction.

The provision of commercially acceptable resealable easy open can end constructions for larger capacity beverage containers requires, in addition to the functional feature of present easy open can ends, both sealable retention of the can contents and accommodation by the resealed cap of the inherent pressure buildup therein. Also required is a can end configuration at the pouring opening to accommodate the disposition of the resealing cap in operative relation thereto without appreciable diminution of the convenience and cost effective nature of the basic easy open end constructions during manufacture, filling, shipping, selling, and consumer usage. As such, the provision of a commercially acceptable resealable easy open end construction requires accommodation of problems not heretofore met in the basic easy open end constructions conventionally employed in the smaller capacity beverage can.

Experience to date with the resealable cap and can end construction disclosed in U.S. Pat. Nos. 4,580,692 and 4,648,528, the disclosure contents of which are herein generally incorporated by reference, has indicated that a pressure buildup within a resealed can in excess of about 20 psi, a not uncommon occurrence, may result in a reverse displacement of the opening panel, i.e., from the inside to outside of the can, due to rapid pressure release occasioned by separation, intended or otherwise, of the resealing cap from the pouring spout. Such reverse displacement of the opening panel and consequent exposure thereof externally of the can interferes with pouring and resealing, which motivates the user to take corrective action, thereby creating a possible cutting hazard to the user if he attempts either to remove the panel or to force it back into the can and, if separated and discarded by the user, creates an undesirable littering potential.

SUMMARY OF THE INVENTION

This invention may be briefly described as an improved easy open can end construction that includes pressure-induced, displacement-responsive venting means incorporated in the resealing cap assembly operative to automatically vent interior pressure at a level below that operative to effect blow off of the resealing cap and to vent internal pressure at a rapid rate during intentional resealing cap removal such that the internal pressure falls below 20 psi before the cap disengages from the can, thereby precluding reverse displacement of the opening panel. In its broader aspects, the invention includes the incorporation of automatic pressure venting means in a resealing cap that is responsive to the cap displacement induced by increasing internal pressure to provide exposable and unobstructed venting channels prior to the disengagement of the sealing cap from normal overlying relation with the can closure. In a narrower aspect, the invention includes a can closure having a spout assembly with an outwardly projecting continuous lip defining a sealing surface and a sealing cap having a dependent skirt with an inwardly directed ledge adapted to fit in interference with the sealing surface on the spout and further including transversely directed channel defining means located in the vertex of such inwardly directed ledge operative to provide exposable pressure venting channels traversing the continuous lip on the spout assembly prior to disengagement of said ledge from sealing relation with the lip. In a still narrower aspect, the subject invention includes selectively contoured venting channels in the marginal defining edge portion of the vertex of the ledge and with one of such notches being disposed in close proximity with a lifting tab associated with the cap.

Among the advantages of the subject invention is the provision of an automatically openable pressure release vent assembly within a resealable cap for easy open can ends that effectively precludes pressure buildup above a predetermined amount in a resealed can. Further advantages include an automatic pressure responsive venting system for resealed easy open ends that effectively precludes blow off of a resealing cap and undesirable reverse displacement of a score line defined opening panel from a location within an opened container to a location external thereof. Still further advantages of the subject invention is the provision of an automatically operable pressure venting system that will assure venting of excessive internal pressure prior to separation, intended or otherwise, of a resealing cap from an opened and resealed container.

The object of this invention is the provision of an automatic pressure release venting system for resealed easy open end beverage containers.

A further object of this invention is the provision of a pressure release venting system for incorporation in the resealable easy open can end constructions of the type disclosed in U.S. Pat. Nos. 4,580,692 and 4,648,528.

Other objects and advantages of the invention will become apparent from the following portions of this specification and from the appended drawings which illustrate, in accord with the mandate of the patent statutes, a presently preferred embodiment of a can end construction that incorporates the principles of this invention.

BRIEF DESCRIPTION OF THE DRAWINGS

FIG. 5 is a section view, on an enlarged scale, showing the incorporation of a transverse pressure venting channel in the resealing cap.

FIGS. 6*a* and 6*b* are plan views, on an enlarged scale, illustrating alternative cross sectional configurations for the venting channel shown in FIG. 5.

DETAILED DESCRIPTION OF THE INVENTION

Figure 1:
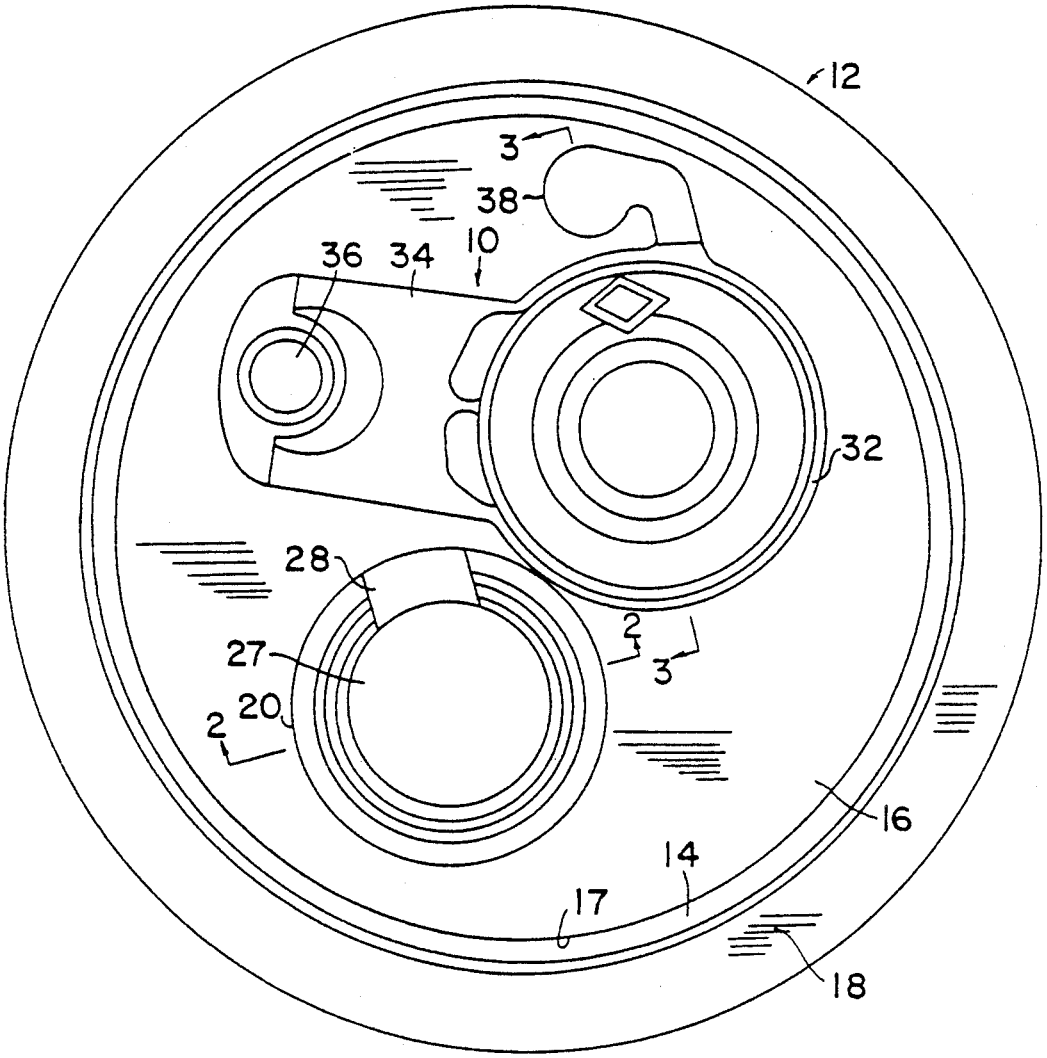
FIG. 1 is a plan view of a resealable easy open end can end construction incorporating the principles of this invention.

As pointed out above, the invention will be described in association with a resealable easy open end construction of the general type disclosed in U.S. Pat. Nos. 4,580,692 and 4,648,528, the disclosure of which is herein incorporated by reference. However it should be understood that the invention may be used in other resealable closure constructions.

Where the words "upwardly", "inward", "outwardly", "under" and the like are used hereinafter, their meaning is to be taken with reference to a can in an upright position having a can end closure incorporating this invention attached to the top end thereof.

Referring to the drawings, the automatic pressure venting system incorporating the principles of this invention is disclosed in association with a can end closure 12 of the general type disclosed in said U.S. Pat. Nos. 4,580,692 and 4,648,528. Such can end closure 12 includes a substantially flat or planar end wall portion 16, a peripheral countersink 14 terminating in an upwardly and outwardly projecting annular flange 18 forming a chime for conventional attachment of the can end to a can body by double seaming.

Figure 2:
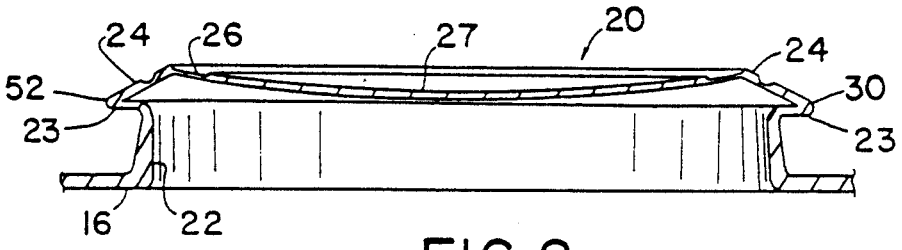
FIG. 2 is a horizontal section as taken on the line 2—2 in FIG. 1.

Included therein, as best shown in FIGS. 1 and 2, is an upwardly projecting spout 20, suitably of circular configuration, located adjacent an edge of the end wall 16. The spout 20 is preferably an integrally formed portion of the end wall 16 and includes an upwardly projecting sidewall 22, an outwardly extending intermediate wall portion 23 and an inclined top wall 24. A score line 26 in the top wall 24 interrupted by a hinge portion 28 partially circumscribes and defines an opening panel portion 27 which is pressed inwardly into the can by fracturing the score line. The score line 26 may be continuous and completely circumscribe the panel to permit complete separation of the panel 27 from the can end, but this is not preferred from an ecology or safety standpoint as a completely severed panel might pass through the opening and be carelessly discarded or swallowed. The juncture of the intermediate wall portion 23 and the inclined top wall 24 provides an outwardly projecting annular lip 30. Associated with the dispensing spout 20 is a resealing cap assembly, generally designated 10.

Figure 3:
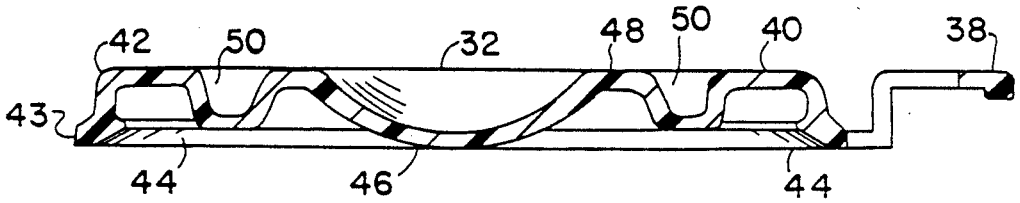
FIG. 3 is a section, on an enlarged scale, as taken on the line 3—3 of FIG. 1 through the sealing cap.

Referring now particularly to FIGS. 1 and 3, the cap assembly 10 is preferably molded in one piece using a plastic material having a low modulus of elasticity, such as low-density polyethylene, for example. The cap assembly 10 is comprised of a seal cap 32, an extending arm 34 and tab means 38 projecting outwardly from the periphery of the seal cap 32 for convenience in manipulation of the cap. The cap assembly 10 is pivotally attached to the end wall 16 with a rivet 36 through an appropriate opening at the remote end of the arm 34.

Figure 4:
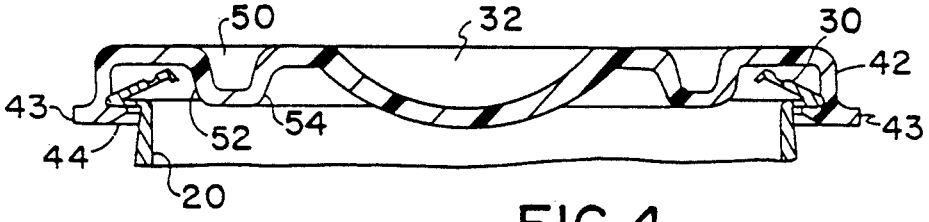
FIG. 4 is a section showing the cap member of FIG. 3 disposed in superposed sealing relation on the spout assembly of FIG. 2.

Referring now particularly to the enlarged showing of FIG. 3, the seal cap 32 includes an annular top wall portion 40 and a depending perimetric skirt 42. An annular lip 43 projects outwardly from the distal end of the skirt, and an annular wedge-shaped ledge 44 projects inwardly from the skirt 42 near the distal end thereof to engage the spout lip 30, as shown in FIG. 4 and as will be discussed later. The top wall of the cap further includes a concave central disc portion 46 surrounded by a second annular top wall portion 48 with an annular groove 50 disposed intermediate the annular portions 40 and 48. The skirt 42 has an inside diameter slightly less than the outside diameter of the spout lip 30 to provide an interference fit therebetween.

Referring to the enlarged showing of FIG. 2, the spout lip 30 is comprised of the juncture of the inclined top wall 24 extending from the score line 26 at a slightly downward angle from horizontal (approximately 15° -25° ) with the substantially horizontal intermediate wall portion 23 underlying the top wall.

As described in greater detail in U.S. Pat. Nos. 4,580,692and 4,648,528, the lip 30 is adapted to maximize the sealing performance provided by the seal portion. The arcuate vertex portion thereof 52 takes advantage of the smooth surface and is formed with a minimal radius to minimize the area of sealing contact so as to maximize the unit pressure in the seal area. Maximizing the unit pressure in the initial seal area by providing a minimal radius on the vertex of the lip 30 is important so that the degree of interference fit between the cap and the lip can be minimized. The less the interference fit required to attain an effective initial seal, the greater the ease in applying and removing the cap from the spout. The arcuate vertex portion 52 presents a substantially smooth surface for the plastic cap surfaces to slide against during application and removal with no degradation of the seal quality or blow-off resistance. The plastic sealing surfaces are therefore not cut, scraped or otherwise damaged during application and removal.

After dispensing a portion of the can contents, resealing of the can, as shown in FIG. 4, can be readily accomplished by repositioning the seal cap 32 in an overlaying position over spout 20 and applying a downward pressure substantially uniformly across the top of the seal cap 32 to effect engagement with the spout 20. Engagement may be made with the least required force by applying downward pressure at a point or relatively small area adjacent the edge of the seal cap so as to concentrate the force necessary to spring only a relatively small segment of the skirt 42 outwardly and downwardly a distance sufficient for the ledge 44 to clear the spout lip 30. Assuming a thumb is used to apply the force, the thumb is then rolled and/or moved progressively around the circumference of the cap until engagement is completed.

To disengage the sealing portion of the cap from the spout, tab 38 is grasped and lifted. Such lifting causes ledge 44 to slide outwardly relative to the bottom surface of spout lip 30 adjacent the line of connection between the tab and the seal cap 32, thereby disengaging ledge 44 from lip 30 at that point. As lifting of tab 38 is continued, the ledge 44 is progressively disengaged around the perimeter of the spout 30.

As previously pointed out, the skirt 42 has an inside diameter less than the outside diameter of the spout lip 30 in order to create hoop tension in skirt 42 when the cap is applied, said hoop tension thereby producing surface compression in the skirt in the seal zone adjacent the vertex 52 of the lip 30. After engagement of sealing cap 32 with the spout 20, escaping gas dissociating from the contained carbonated beverage causes pressure within the can to steadily increase. Such pressure is sealed in by said surface compression of the skirt 42 thereby reducing or eliminating said surface compression and concomitantly the seal. Resistance to said increase in diameter of skirt 42 could be increased by increasing the cross-sectional area of skirt 42 but the amount of increase required to be effective would substantially increase the application force. The preferred means to resist increase in the diameter of the skirt 42 is to increase the frictional force between the upper surface of the ledge 44 of the cap 32 with the undersurface of the intermediate wall portion 23 inwardly adjacent to the lip vertex 52. In more particularity, maintenance of a high frictional resistance against sliding displacement of the upper surface of the ledge 44 relative to the undersurface of the intermediate wall portion effected by maintaining the angle of contact therebetween less than the friction angle effectively functions to resist the tendency of internal pressure increases to increase the cap diameter at the sealing surface with its consequent degradation of the seal. Maintaining said contact angle less than the friction angle therefore produces maximum seal security with minimum application force because the interference fit between skirt 42 and lip 50 has to be only that which will establish the initial seal at low or no pressure.

As noted earlier, experience to date has indicated that sudden release of pressures in excess of 20 psi from a resealed container will sometimes result in a reverse displacement of the opening panel 27 from a location inside the can to one externally thereof. It has also been ascertained that such sudden release of pressure can result from a pressure induced blow off of the sealing cap as well as occurring during an intentional manual separation of the sealing cap from the spout assembly.

In order to insure automatic venting of internal pressures prior to complete separation of the sealing cap 32 from the spout assembly 20 a plurality of transverse venting channels 56 (see FIG. 5) are incorporated in the inner marginal edge portion of the inwardly directed ledge 44 of the sealing cap 32. As is shown in FIGS. 6*a* and 6*b* the channels 56 may be in the form of arcuate recesses 58 or may be of other configurations such as rectangular 60 or V-shaped. The preferred depth of the channels 56 ranges from the total to somewhat less than the total transverse depth of the ledge 44 and preferably such plurality of channels, as for example, four, are equally spaced around the ledge periphery. Also, one of such channels 56 is desirably located adjacent to the lifting tab 38 for the reasons hereinafter pointed out.

Information available to date indicates that an unchanneled cap does not blow off the spout 20 until the circumferential length of the vertex of the ledge 44 has stretched sufficiently to permit a portion of the vertex, as for example 50%, to pass over the periphery of the lip 30. If the cap 32 were to stretch uniformly and remain perfectly concentric with the lip 30, the diameter of the vertex of the ledge 44 would be equal to the diameter of the lip 30 at the instant of blow off. In reality, however, the cap 32 does not usually remain concentric with the spout and localized stretching thereof will occur. Because of such probable non-concentricity between cap and spout and non-uniform stretching of the ledge 44 circumference the disposition of a plurality of channels 56 in spaced relation around the periphery of the ledge 44 operates to insure a reasonable consistency of venting pressures.

As pointed out above, degradation of the seal at the vertex of the lip 30 and the cap 32 under increases in internal pressure will be resisted by the frictional interfacial engagement intermediate the upper surface of the ledge 44 and the undersurface of the intermediate wall portion 23. The interfacial friction forces will be greater than the diameter increasing forces as long as the contact angle is less than the friction angle, but an increase in internal pressure above a predetermined value sufficient to distort the ledge 44 and increase the contact angle above the friction angle will decrease the interfacial friction forces and permit the vertex of the ledge 44 to slide outwardly relative the undersurface of the intermediate wall portion 23 thereby permitting an increase in the circumferential length of the skirt. When such outward displacement of the ledge 44 is sufficient to expose at least one of the channels 56, venting is automatically initiated therethrough with an accompanying initiation of pressure reduction within the can. During manual cap removal, the channel or channels 56 that are adjacent tab 38 have to be of sufficient depth and area to vent the pressure to less than 20 psi before the cap 32 disengages from the spout 20 in order to prevent reverse displacement of panel 27.

The actual automatic venting pressure of the cap is a function of many design variables including the angle of contact between the upper surface of the ledge 44 and the undersurface of the lip 30; the resistance of the cap to rotation of the ledge 44 that would increase the contact angle when subjected to increasing internal pressure; the dimension of the un-notched portion of the ledge that remains at the vent channels; the resistance of the skirt 42 to diametral increase when subjected to increasing internal pressure, and the amount of interference fit between the skirt 42 and the spout annular lip 30. For a cap of given resinous or plastic material, the blow-off and venting pressures may be increased by decreasing and maintaining contact angles below the friction angle, by increasing the un-notched remainder at the vent channels, by increasing the resistance of the skirt to diametral expansion, and by increasing the interference fit.

However, automatic blow-off pressure is only one of the necessary criteria that have to be met; application force and the amount of carbonation that is lost when automatic venting occurs are also important. Application force is increased by increasing the resistance of the skirt to diametrical expansion and by increasing the interference fit, because these design options resist application in the very same manner as they resist blow-off. Carbonation loss is increased by increasing the un-notched remainder of the vent channels, because larger un-notched remainders require more stretching of the skirt to uncover a venting channel and therefore require more time to recover to their original diameter and re-establish a gas tight seal, which requires that the interference fit between the skirt and spout lip be re-established. The time delay to re-establish a gas tight reseal after venting is exacerbated by the fact that, when subjected to large deflections, the resinous or plastic compounds appropriate for the cap do not behave in a truly elastic manner. Rather than immediately springing back to their original size and shape when the stress is removed as truly elastic materials do, the resinous or plastic compounds appropriate for the cap recover slowly by a phenomenon known as plastic memory. Experience has shown that caps having un-notched remainders of 50% of the total depth of the ledge 44 have taken as long as 8–10 hours to re-establish a gas tight seal, by which time most of the carbonation had been lost.

The foregoing illustrates that the preferred design is one that uses the minimum interference fit necessary to achieve a satisfactory initial seal which keeps application force low, one that maximizes the benefits of reducing and maintaining the contact angle below the friction angle to achieve satisfactory blow-off and venting pressures, one that minimizes the resistance to diametral expansion of the skirt to keep application force low, and one that uses the minimum un-notched residual at the vent channels (preferably none) to minimize carbonation loss after venting.

As noted above, a preferred location for one of the venting channels 56 is adjacent to the lifting tab 38. With a channel 56 in such location, a pulling on the lifting tab as in effecting the separation of the cap 32 from the spout 20, will operate to initially expose such venting channel and permit pressure venting to occur prior to a pressure induced or pressure supplemented blow off of the cap 32 from the spout.

Having thus described our invention, we claim:

1. In a container closure for an open mouth container having a liquid content from which a gas dissociates, the combination comprising:

a spout assembly having a score line defined opening panel therein and an outwardly projecting continuous lip defining a substantially smooth sealing surface surrounding said opening, a sealing cap adapted to removably overlie said spout assembly, said sealing cap including, a top wall, a skirt depending from said top wall adapted to fit in sealing interference with said sealing surface on said spout, said skirt having an inwardly directed ledge at its distal end that includes an upper ledge surface adapted to be disposed in interfacial sealing engagement with at least a portion of said sealing surface in aid spout assembly and a lifting tab extending outwardly from the skirt, and at least one channel means in said inwardly directed ledge in close proximity to said lifting table to provide at least one exposable unobstructed pressure venting channel traversing said continuous lip for interrupting the interfacial sealing engagement between said upper ledge surface and said projecting lip in said spout assembly in response to outward displacement of said upper ledge surface relative to said sealing surface in said spout assembly.

2. The combination as set forth in claim 1 wherein said inwardly directed ledge includes a plurality of channel means therein.

3. The combination as set forth in claim 2, wherein said channel means located in proximity with said lifting tab is of greater cross-sectional extent than the remainder of said channel means.

4. The combination as set forth in claim 1 wherein said sealing cap is formed of deformable material having a low modulus of elasticity.

5. In a container closure for an open mouth container having a liquid content from which a gas dissociates, the combination comprising:

a spout assembly having a score line defined opening panel therein and an outwardly projecting continuous lip whose vertex and undersurface provide a substantially smooth sealing area surrounding said opening, a sealing cap adapted to removably overlie said spout assembly, said sealing cap including a top wall, a skirt depending from said top wall adapted to fit in sealing interference with the vertex of said outwardly projecting lip on said spout assembly, said skirt having an inwardly directed ledge that includes an inwardly directed vertex and an upper ledge surface adapted to be disposed in interfacial sealing engagement with the undersurface of said outwardly projecting lip on said spout assembly and having a lifting tab extending outwardly of the cap, and at least one transversely directed channel means selectively disposed in the marginal edge portion of said inwardly directed vertex of said ledge in close proximity to said lifting tab to provide at least one exposable unobstructed pressure venting channel traversing said continuous lip for interrupting the interfacial sealing engagement between said upper ledge surface and the undersurface of said projecting lip in response to outward displacement of said upper ledge surface relative to said undersurface of said continuous lip.

6. The combination as set forth in claim 5 wherein said inwardly directed ledge includes a plurality of channel means of predetermined depth in the marginal edge portion of said inwardly directed vertex of said ledge.

7. The combination as set forth in claim 6 wherein said channel means located in proximity with said lifting tab is of greater cross-sectional extent that the remainder of said channel means.

8. The combination as set forth in claim 5 wherein said sealing cap is formed of elastically deformable material having a low modulus of elasticity.

9. A closure for a beverage container whose carbonated contents may cause the development of undesirably high internal pressure, the combination comprising:

a spout in a portion of a generally planar end panel of the container having an opening therein and an outwardly projecting continuous lip defining a substantially smooth sealing surface surrounding said opening, said lip disposed above the general plane of the end panel of the container, a sealing cap adapted to removably overlie said spout, said sealing cap including, a top wall, a skirt depending from said top wall adapted to fit in sealing interference with said sealing surface on said spout and having an inwardly directed ledge at its distal end with an upper ledge surface adapted to be disposed in interfacial engagement with said projecting lip in said spout assembly and having a tab for lifting the closure from said spout, and at least one channel means in said inwardly directed ledge adjacent to said tab for interrupting said sealing engagement between said upper ledge surface and said projecting lip in said spout assembly in response to outward displacement of said upper ledge surface relative to said projecting lip.

10. A closure as set forth in claim 9 which is formed of deformable material.

11. A closure as set forth in claim 9 which has a plurality of channel means.

12. A closure for a beverage container whose carbonated contents may cause the development of undesirably high internal pressure, the combination comprising:

a spout in a portion of a generally planar end panel of the container having an opening therein and an outwardly projecting continuous lip whose vertex and undersurface provide a substantially smooth sealing area surrounding said opening, said lip disposed above the general plane of the end panel of the container, a sealing cap adapted to removably overlie said spout above the general plane of the end panel of the container, said sealing cap including a top wall, a skirt depending from said-top wall adapted to fit in sealing interference with the vertex of said outwardly projecting lip on said spout and having an inwardly directed ledge at its distal end and a lift tab extending outwardly from the cap, said inwardly directed ledge including an inwardly directed vertex and an upper ledge surface adapted to be disposed in sealing interfacial engagement with the undersurface of said outwardly projecting lip in said spout, and at least one transversely directed channel means selectively disposed in the marginal edge portion of said inwardly directed vertex of said ledge adjacent to said lift tab, for interrupting said sealing engagement between said upper ledge surface and the undersurface of said continuous lip on said spout in response to displacement of said upper ledge surface relative to said continuous lip.

13. A closure as set forth in claim 12 which is formed of deformable material.

14. A closure as set forth in claim 12 which has a plurality of channel means.

* * * * *